United States Patent [19]

Lee

[11] Patent Number: 4,789,867

[45] Date of Patent: Dec. 6, 1988

[54] WINDING-TYPE ANTENNA AND ITS WINDING MECHANISM

[76] Inventor: Jang-Woo Lee, Seoul, Rep. of Korea

[21] Appl. No.: 84,148

[22] Filed: Aug. 12, 1987

[30] Foreign Application Priority Data

Feb. 25, 1987 [KR] Rep. of Korea ..... 1628/1987

[51] Int. Cl.[4] ..... H01Q 1/08

[52] U.S. Cl. ..... 343/877; 343/903

[58] Field of Search ..... 343/877, 900, 901, 903, 343/714, 715, 711; 242/54 A

[56] References Cited

U.S. PATENT DOCUMENTS

| | | | |
|---|---|---|---|
| 2,840,199 | 6/1958 | Marris | 343/877 |
| 2,842,768 | 7/1958 | Halperin | 343/877 |
| 3,177,987 | 4/1965 | Swaim | 343/877 |
| 4,117,495 | 9/1978 | Hochstein | 343/877 |

FOREIGN PATENT DOCUMENTS

| | | | |
|---|---|---|---|
| 429609 | 5/1926 | Fed. Rep. of Germany | 343/877 |
| 1225839 | 9/1966 | Fed. Rep. of Germany | 343/877 |
| 59-37882 | 9/1984 | Japan . | |

*Primary Examiner*—William L. Sikes
*Assistant Examiner*—Michael C. Wimer
*Attorney, Agent, or Firm*—Jones, Tullar & Cooper

[57] ABSTRACT

An extensible antenna, particularly for automobiles, incorporates a plurality of inter-connectable elements which are separated and wound on separate reels when the antenna is retracted. The antenna elements pass from the reels through a connecting mechanism, such as a plurality of rollers, to be connected together for extension of the antenna. The antenna elements each are formed with a longitudinal groove on one surface and a longitudinal projection on another surface, and are shaped so that the projection on one element is pressed into engagement with a corresponding groove on the next adjacent element by the rollers as the antenna is extended, to form a connected antenna.

9 Claims, 3 Drawing Sheets

WINDING-TYPE ANTENNA AND ITS WINDING MECHANISM

BACKGROUND OF THE INVENTION

The present invention relates to a winding-type antenna and its winding mechanism for use in automobiles and the like.

The winding-type antenna in which a flexible antenna is wound on a reel for storage, and is unwound when it is to be extended for use, has been made known by the U.S. Pat. No. 4,117,495 and by Japanese Pat. No. 59-37882 in 1984.

A winding-type antenna must be, in the first place, so strong as not to be broken even when pulled upward, or extended at a high speed. In the second place, the antenna must be easily wound, or retracted, and drawn out, or extended. In the third place, it must be manufactured in an easy way. However, it has been found that the winding-type antenna described in the prior art is defective because it cannot meet all of these requirements. Therefore, it is an object of the present invention to provide an antenna and its winding mechanism which are able to meet such requirements.

SUMMARY OF THE INVENTION

The present invention is directed to an antenna structure and a winding mechanism for the antenna which not only leaves the antenna unbroken even when wound or unwound at a high speed. This is accomplished by forming the antenna with more than two connecting elements so that those elements will depend on one another to provide the required strength. The antenna further is constructed so that its winding mechanism can be installed easily in a confined engine compartment of a vehicle by disconnecting the combined elements so that each element may be wound on a corresponding, separate reel when it is wound.

Although it is relatively simple for such an antenna to be wound by turning a reel in one direction, it is found that still it is not easy to unwind the separate elements of an antenna from the reel, to unite the disconnected elements, and at the same time to push it upward simply by giving a backward turn to the reel.

In the case of the present invention, an antenna is formed by means of more than two connecting elements wherein the elements are provided with a connecting means which connects each element to its next adjacent element unyieldingly. The invention further includes a mechanism which winds such an antenna. This mechanism comprises not only a means which winds and stores the antenna elements but also an assembly mechanism which presses the disconnected elements together and transfers them upwardly as the antenna is extended.

BRIEF DESCRIPTION OF THE DRAWINGS

The following is a detailed explanation of an embodiment of the present invention according to the drawings attached hereto, in which.

DESCRIPTION OF PREFERRED EMBODIMENTS

Figure 1:
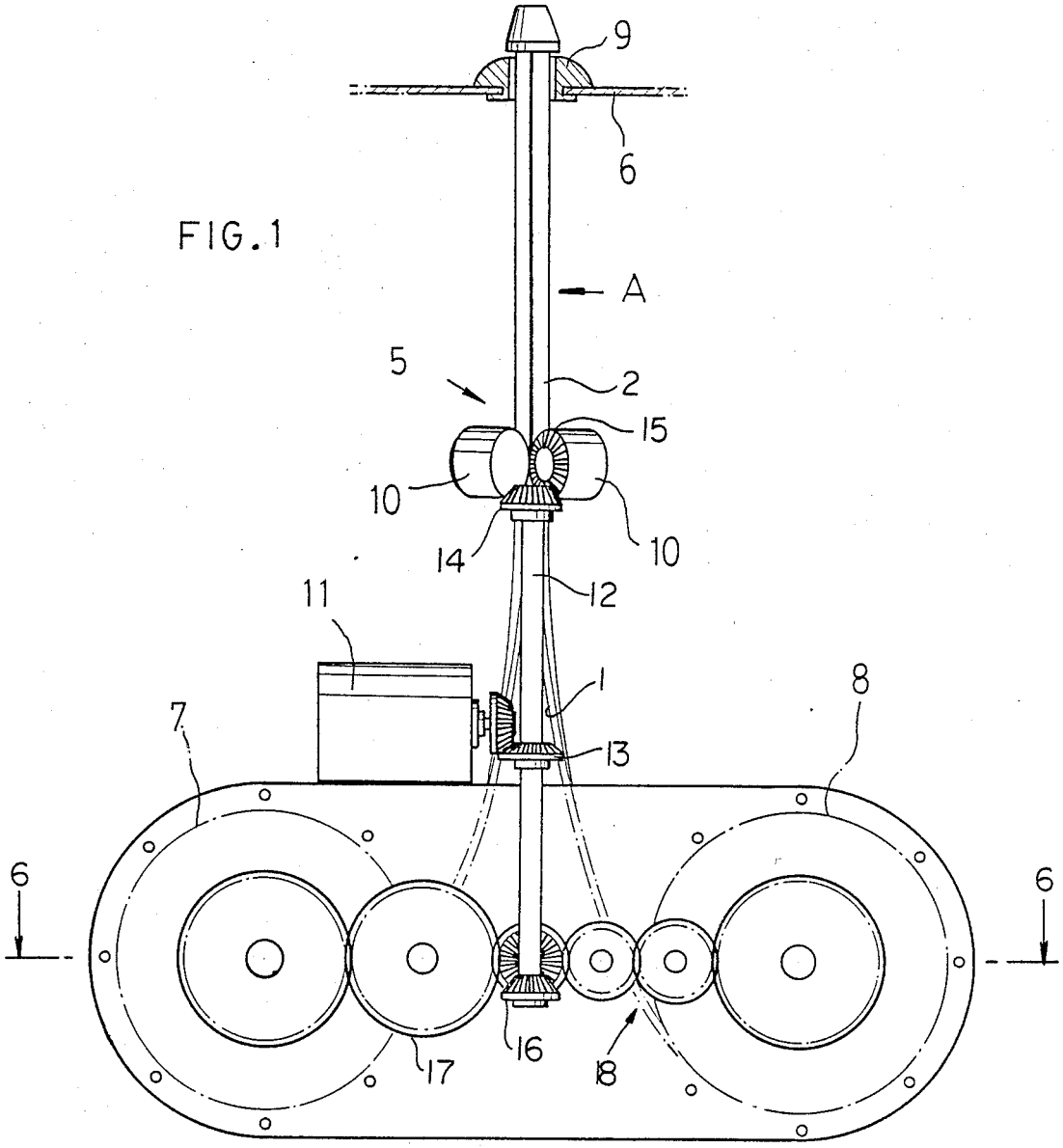
FIG. 1 is a front view of an embodiment of the present invention.
Figure 2:
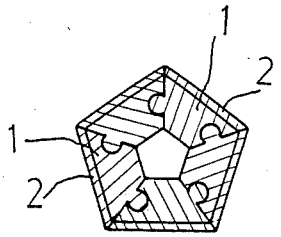
FIG. 2 is a cross-sectional view of an antenna in accordance with present invention.
Figure 3:
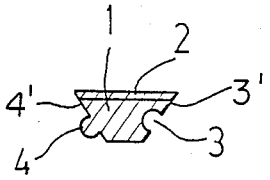
FIG. 3 is a cross-sectional view of one of the antenna's connecting elements.
Figure 4:
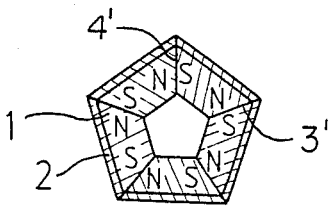
FIG. 4 is a sectional view of another embodiment of the antenna under the present invention.
Figure 5:
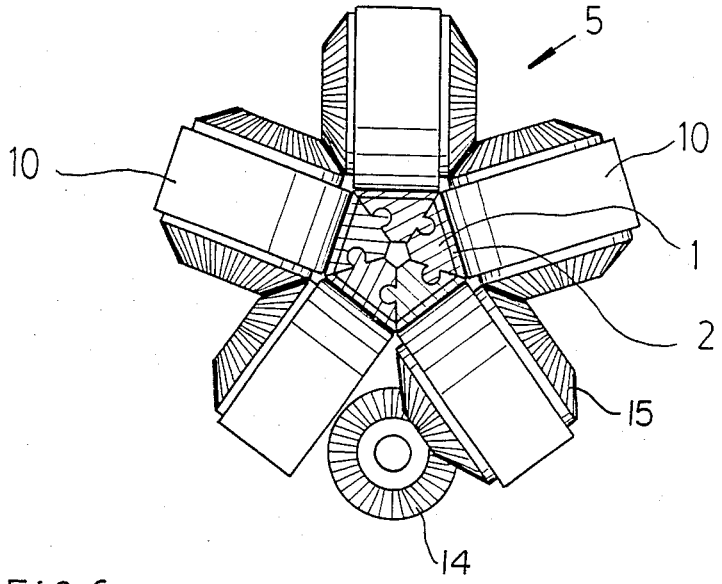
FIG. 5 is a top plan view, with the antenna in cross-section, of an assembly mechanism which unites the connecting elements of the antenna and presses it upwardly from the winding mechanisms in accordance with the present invention.

The antenna A, illustrated in FIG. 1 in accordance with the present invention is formed from a plurality of identical elongated elements (1), which are shown in cross-section in FIGS. 2, 3 and 5. The elements are united as the antenna is extended and are disconnected as the antenna is retracted and wound. The antenna A is formed from more than two elements (1) which are joined together by the assembly mechanism of FIG. 5, as will be discussed below. Each element (1) is flexible, and each includes a metal layer (2) attached to its outside surface so that the exterior of the assembled antenna will be metallized to receive radio waves. The element (1) must include a fastener, or interlock, mechanism by which it can be united with other adjacent elements of the antenna as it is extended. The preferred embodiments of such a fastener mechanism are illustrated in FIGS. 2 to 4.

As illustrated in FIG. 2 and FIG. 3, five elements are assembled to produce the unified antenna A, with each element incorporating a fastener mechanism which includes a groove (3) formed in the joining surface 3′ on the one side of the element (1) and a projection (4) on the other joining surface 4′ of the element. Alternatively, as illustrated in FIG. 4, elements (1) can be united by providing the joining surfaces 3′ and 4′ of each element with oppositely poled magnetism.

As to the connecting means of the antenna, it is advantageous in terms of manufacture or in terms of connecting strength that the projections (4) and grooves (3) are formed on the joining surfaces of the adjacent elements, as illustrated in FIG. 2 and FIG. 3 extend longitudinally along the elements so that the groove on the surface of one element interlocks with the projection on the facing surface of the next adjacent element.

Figure 6:
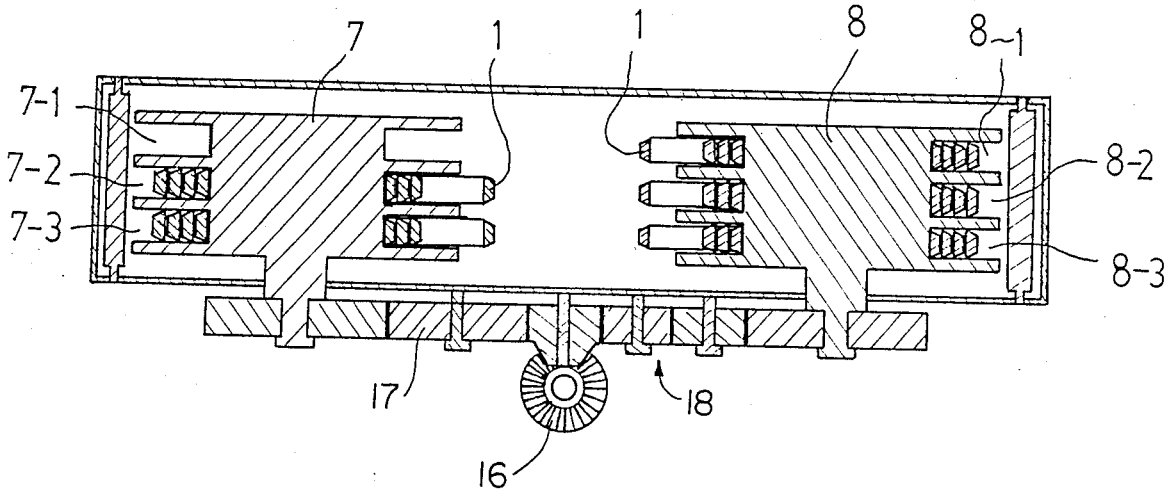
FIG. 6 is a sectional view along line 6—6 of FIG. 1 showing a winding mechanism.

However, such an antenna requires not only a relatively great force to produce the connected condition from its disconnected state but also a particular mechanism to provide the connected condition. Thus, the present invention incorporates a uniting/transferring, or assembly mechanism which unites the disconnected antenna elements as it extends the antenna, and a winding mechanism which separates the antenna elements and winds them on reels as the antenna is retracted. The assembly mechanism and the winding reels are illustrated in FIGS. 1, 5 and 6.

As illustrated in FIG. 1, when the antenna is lowered and wound, the upper part of antenna A extending from uniting/transferring mechanism (5) to the body of an automobile (6) requires no disconnection of each element (1), so the upper part above uniting/transferring mechanism is fixed as by securing the elements 1 together by welding or other means. In the lower part of antenna (A), below mechanism 5 each element can be disconnected from its adjacent elements and each disconnected element is made to be wound on winding drums separately.

The winding drums can be installed in the same number as that of elements, but when installed in such a manner, a great deal of room is required. So, in the embodiment illustrated in the drawings attached hereto, all elements are wound on two separate winding drums (7) and (8). Accordingly, each winding drum (7)(8) is provided with a plurality of reels (7-1, 7-2, 7-3, 8-1, 8-2, 8-3) to enable one element to be wound to one reel.

The uniting/transferring mechanism (5) is installed directly under the outlet (9) for the antenna formed on the body of an automobile. The mechanism provides each antenna element (1) with a corresponding roller (10) which presses it in the direction of the center for upward or downward transfer. Accordingly, it is desirable that the number of rollers (10) is equal to the number of antenna elements. Only one roller can be made to be interlocked with a motor (11) but, in the drawing attached hetero, an embodiment is illustrated, where one roller is interlocked with a motor (11) by drive shaft (12) and gears (13) and (14). The rollers (10) each carry meshing teeth (15) engaging with the next adjacent rollers, so the motor drives all the rollers. The drive shaft also drives the drums (7) and (8) by way of gears (16), (17) and (18).

Thus, when the antenna (A) of the present invention is extended to the outside of the body of an automobile (6) by driving the winding drums (7)(8) and uniting/-transferring mechanism (5), the elements wound on the reels of winding drums (7)(8) are drawn upwardly through rollers 10, are united by the uniting/transferring mechanism (5) and are pushed upward.

When the antenna drawn to the outside of the body of an automobile gets a strong shock, it bends and the connected condition between each element is destroyed.

Thus, the antenna (A) is amorphous when each element (1) is disconnected. In order to restore the antenna (A), it must be drawn downwardly into the body of an automobile and wound to the winding drums (7) (8), through the uniting/transferring mechanism (5), and then pushed upward again.

Accordingly, the antenna under the present invention is not harmed by being broken down, and it is not only simple to use but also convenient to set it up in the narrow engine compartment as it is not bulky.

What is claimed is:

1. An extensible antenna, comprising:

a plurality of elongated antenna elements, each having at least two joining surfaces, one joining surface having a longitudinally extending groove and the other joining surface having a longitudinally extending projection;

reel means for storing each of said antenna elements when the antenna is retracted; and an assembly mechanism engaging and withdrawing said antenna elements from said reel means and interconnecting said antenna elements to extend the antenna, said assembly mechanism including means pressing an elongated projecting on a joining surface of one of said plurality of antenna elements into a corresponding groove on a joining surface of a next adjacent antenna element whereby adjacent antenna elements are interconnected to produce a unitary extended antenna.

2. The antenna of claim 1, further including common drive means connected to said reel means and to said assembly mechanism for driving said reel means and said assembly mechanism in one direction to cause said assembly mechanism to extend said antenna, and in the opposite direction to cause said reel means to retract said antenna and to thereby separate and wind said antenna elements onto corresponding reel means.

3. The antenna of claim 1, wherein each said antenna element further includes an outside surface between said joining surfaces, said outside surface including a metal piece secured thereto.

4. The antenna of claim 1, wherein said plurality of antenna elements includes more than two elements, each element being identical in cross-sectional shape to the others.

5. The antenna of claim 1 wherein said assembly mechanism includes a roller for each of said antenna elements, said rollers engaging corresponding antenna elements to press said antenna elements together to interlock adjacent grooves and projections as said antenna is extended.

6. The antenna of claim 5, further including driving means driving said assembly mechanism to extend said antenna.

7. The antenna of claim 5, further including drive means driving said reel means.

8. The antenna of claim 5, further including drive means connected to said reel means and to said rollers for driving said roller in one direction to extend said antenna, and for driving said reel means in the opposite direction to retract said antenna and to thereby separate and wind said antenna elements onto corresponding reel means.

9. An extensible antenna having a retracted position and an extended position, comprising:

a plurality of elongated antenna elements each having at least two joining surfaces and an outside surface, one joining surface having a first interlock means and the second joining surface having a second interlock means;

reel means for each of said plurality of antenna elements, said reel means storing corresponding antenna elements when said antenna is in the retracted position;

a plurality of roller means, each roller means engaging the outside surface of a corresponding one of said antenna elements, said roller means pressing said antenna elements together to cause the first and second interlock means of adjacent joining surfaces to engage to form a united antenna; and drive means connected to said reel means and to said roller means for extending and retracting said antenna.

* * * * *